United States Patent [19]

Geller

[11] Patent Number: 4,951,366

[45] Date of Patent: Aug. 28, 1990

[54] METHOD FOR MODIFYING FABRICS TO PRODUCE VARIED EFFECTS

[76] Inventor: George R. Geller, 448 Neptune Ave., Brooklyn, N.Y. 11224

[21] Appl. No.: 308,995

[22] Filed: Feb. 7, 1989

[51] Int. Cl.[5] ..... D06C 11/00; D06C 23/02

[52] U.S. Cl. ..... 26/28

[58] Field of Search ..... 26/28; 15/1.5 R, 306 A; 51/310, 317, 319, 320, 431, 432, 433, 434

[56] References Cited

U.S. PATENT DOCUMENTS

| | | | |
|---|---|---|---|
| 930,522 | 8/1909 | Weiss | 26/28 X |
| 2,053,778 | 9/1936 | Platt | 26/28 |
| 2,277,937 | 3/1942 | Shryer | 26/28 UX |
| 2,980,933 | 4/1961 | Schwartz et al. | 15/1.5 R |
| 2,993,309 | 7/1961 | Barnes et al. | 51/431 X |
| 3,045,273 | 7/1962 | Bruno | 15/306 A |
| 3,256,581 | 6/1966 | Thal et al. . | |
| 3,523,346 | 8/1970 | Bolen et al. | 26/28 X |
| 3,536,528 | 10/1970 | De Geest | 15/1.5 R X |
| 3,549,398 | 12/1970 | Watson | 51/319 X |
| 3,553,801 | 1/1971 | Hadley | 26/28 |
| 3,613,186 | 10/1971 | Mazzone et al. . | |
| 3,660,213 | 5/1972 | Shepherd et al. . | |
| 3,660,218 | 5/1972 | Ezekiel et al. . | |
| 3,785,016 | 1/1974 | Hergert . | |
| 3,872,557 | 3/1975 | Benzaquen | 26/28 |
| 3,894,318 | 7/1975 | Ito et al. | 26/28 |
| 3,911,281 | 10/1975 | Ihme . | |
| 3,939,536 | 2/1976 | Ruppe . | |
| 3,952,555 | 4/1976 | Bascum . | |
| 3,973,359 | 8/1976 | Spencer et al. . | |
| 3,986,824 | 10/1976 | Waibel et al. . | |
| 4,012,815 | 3/1977 | Benzaquen | 26/28 |

FOREIGN PATENT DOCUMENTS

| | | | |
|---|---|---|---|
| 806482 | 2/1974 | Belgium . | |
| 2335636 | 7/1977 | France . | |
| 2499833 | 8/1982 | France . | |
| 46-9876 | 3/1971 | Japan | 26/28 |
| 46-9877 | 3/1971 | Japan . | |
| 53019480 | 2/1978 | Japan . | |
| 53031887 | 3/1978 | Japan . | |
| 54-006978 | 1/1979 | Japan . | |
| 1134248 | 1/1985 | U.S.S.R. | 15/1.5 R |
| 649979 | 2/1951 | United Kingdom | 26/28 |
| 817184 | 7/1959 | United Kingdom | 51/432 |
| 1436837 | 5/1976 | United Kingdom . | |
| 2051164 | 1/1981 | United Kingdom . | |

OTHER PUBLICATIONS

Automated Blasting Systems, Blast-it-all.

Pressure Blast Cleaning Equipment, Clemco Industries.

Silverado Blast Cabinets, Clemco.

U.S. Army Natick Laboratories report, "Fabric Abrasion by a Sand Blast Method", Oct. 7, 1964, pp. 1-3 and FIGS. 1-7.

Specialized Blast Cleaning Equipment, Clemco Industries.

Airblast Cabinets, Bulletin No. 120.02.

Wheelabrator Equipment and Services for More Profitable Materials Cleaning, Bulletin No. 10-00.

Blueprint for More Business-More Profits, Bulletin No. 190-E.

Wheelabrator Manual of Blast Cleaning Abrasives Technology, Bulletin No. 12-00.

(List continued on next page.)

*Primary Examiner*—Werner H. Schroeder

*Attorney, Agent, or Firm*—Ladas & Parry

[57] ABSTRACT

A method for modifying fabrics to produce varied effects comprises projecting a stream of particles towards the fabric surface. The particles are projected under controlled conditions such that they contact the surface with a force effective to modify the fabric and change the feel, appearance or material constitution of the fabric. Among the effects obtained are softening, worn or laundered appearance, design, pattern, picture, printing, textured or sculptured effects. The apparatus comprises a supply of a length of fabric and means for moving the fabric along a horizontal path. Located on the path is a support backing such as a flat plate, and means for slidably pressing the fabric against the support backing. Opposite to the support backing and facing the fabric surface is a treatment station which includes means for propelling a stream of particles towards the fabric surface.

23 Claims, 3 Drawing Sheets

OTHER PUBLICATIONS

Richard A. Herard, "Creating Excitement in Fabrics by Napping, Shearing, Sueding and Sanding", Dyers Dyegest, Nov. 1981, p. 3.

Dyers Dyegest, "Cloth Sanding Creates New Finishes", Sep. 1979, p. 10.

U.S. Army Natick Laboratories Report, "Fabric Abrasion by a Sand Blast Method", Oct. 7, 1964, pp. 1–3, and Figures.

Walter Franke, "Improved Finishing Effects by Sanding Woven and Knitted Fabrics", Melliand Textilberichte–International Textile Reports, 65, No. 1, Jan. 1984, p. 72.

Textile Industries, May 1978, p. 40.

METHOD FOR MODIFYING FABRICS TO PRODUCE VARIED EFFECTS

This is a continuation of co-pending application Ser. No. 872,185, filed on June 9, 1986, now abandoned.

BACKGROUND OF THE INVENTION

1. Field of the Invention

This invention relates to methods and apparatus for modifying fabrics to obtain varied effects. More particularly, the invention is concerned with treating fabrics to change the feel (hand), appearance or material constitution of the fabrics.

2. Description of the related art including information disclosed under Sections 1.97–1.99.

Many kinds of treatments or modifications of fabrics have been practiced for a long time. Fabrics at different stages of manufacture have been treated to alter existing characteristics and obtain a fabric which is more useful or more attractive to the ultimate user of an article made from such fabric. Known practices include modifying fabrics by laundering, beating, shearing fibers, selectively heating portions, selectively dyeing or bleaching, ironing, brushing or abrading, pressing with heated drums or patterned rolls and treating with jets of hot fluids. Techniques such as laundering, brushing or abrading with sandpaper have been employed to obtain the effect of a worn or laundered appearance, which is attractive to the user of the article. Methods involving such techniques as shearing fibers, treating with hot fluid jets or using heated drums or patterned rolls are employed to create designs or sculptured effects particularly on pile fabrics. By means of these known techniques, fibers in the pile fabrics are selectively cut, crushed or through heating especially of synthetic fibers, melted or softened so that a patterned or sculptured effect is formed in the treated locations which are altered in contrast with portions of the fabric where the fibers are untreated. Known techniques involving dyeing or bleaching have been used to produce design effects or patterns, and abrading by sanding methods have been employed to create textured or napped surfaces.

For example, in order to obtain the desired worn or laundered effect especially on denim fabric, several techniques are employed and others have been attempted. The manufacture of denim garments often includes washing the garments in various ways including regular mechnical laundering, a chlorine bleach washing, enzyme washing or stonewashing. In the latter technique, the fabric in the form of garments is washed in the presence of pumice stones in a mechanical laundering system including chlorine bleaching. By removing sizing and dye, garments are obtained which are softer and have a faded or worn look. It is also known to treat the fabric prior to the manufacturing of the garment, though commercially impractical. Fabrics have been subjected to mill washing with agitation, to remove starch. Brushing or sanding methods have been proposed to remove surface starch and surface dye but such methods have been considered to unduly weaken the fabric and are limited because they affect only the surface of the fabric.

Lesley U.S. Pat. No. 3,952,555 issued on Apr. 27, 1976 describes providing warp knit denim fabrics having the appearance of woven denim fabrics, by selectively dyeing the knit yarns. The surface of the knit fabric is sanded by contact with a machine having a sanding roll, or is napped with a napping machine having pile rolls, to enhance the denim effect.

In Mazzone et al U.S. Pat. No. 3,613,186 granted on Oct. 19, 1971, jets of hot fluid such as hot air are directed at fabric having a thermoplastic surface to , soften and sculpture the threads. Hergert U.S. Pat. No. 3,785,016 issued Jan. 15, 1974 contacts a pile fabric with a pattern roll which produces surface patterns by different treatment thermal sculpturing and ironing. Ruppe U.S. Pat. No. 3,939,536 issued on Feb. 24, 1976 discloses apparatus which compresses pile fabrics between to provide a crushed appearance. Thal et al U.S. Pat. No. 3,256,581 issued on June 21, 1966 discloses apparatus for treating pile fabrics in which a plurality of fluid discharge nozzles are moved relative to a pile fabric and also relative to each other, to impart a desired design in the pile fabric. It is disclosed that the application of jets of heated fluids to the face of pile fabrics affects the fibers in a way to cause patterns or designs.

However, the known methods for treating fabrics have a number of disadvantages. Such methods are generally capable of producing only a single specific type of effect or modification of the fabric, or a very limited range of such effects. The known techniques are usually useful only with respect to a limited class of fabrics. Installation of expensive equipment is required to carry out many such methods, and the equipment cannot be readily modified to produce any wide range of different types of effects on varying types of fabrics. Furthermore, some of the methods as noted above tend to weaken or otherwise degrade the fabric to an unacceptable extent.

SUMMARY OF THE INVENTION

The present invention provides a method for modifying a wide variety of fabrics, for the purpose of achieving varied changes or effects in such fabrics. Relatively simple equipment may be employed to achieve these effects, and the same equipment can be used to treat many different kinds of fabrics and to produce a great variety of effects by changing the operating conditions of the equipment rather than by any substantial modification or replacement of equipment as would be required in employing techniques of the prior art. The present invention produces desired effects by protecting a stream of particles at a surface of the fabric to be treated, under controlled conditions of treatment. The particles contact the surface at desired locations with a controlled force such that the physical appearance or feel of the fabric, or the physical characteristics of the fabric are modified. With appropriate choice of conditions, the force of the particles is adjusted such that the desired type of modification can be achieved.

In this way, the method is useful to provide an effect of softening or a soft-hand feel, a worn or laundered appearance, the creation of designs, patterns, pictures, printing effects, textured effects or sculptured effects, or combinations of various of these effects.

Accordingly the present invention provides a method for modifying fabrics to produce varied effects, which comprises projecting under controlled conditions a stream of particles towards a surface of a fabric, the particles contacting said surface with a force effective to modify said fabric sufficiently so that one or more of the feel, appearance or material constitution of said fabric is changed.

In accordance with another aspect of the present invention, there is provided a method for the treatment of fabrics to produce a softening (soft-hand), worn or laundered effect, which comprises projecting under controlled conditions a stream of particles towards a surface of a fabric, the particles contacting said surface with a force effective to remove or partially remove from said fabric one or more of coatings sizes, dyes or pigments.

In accordance with yet another aspect of the present invention, there is provided a method for the treatment of fabrics to form designs, patterns, pictures or printing effects, which comprises projecting under controlled conditions a stream of particles towards a surface of a fabric, the particles contacting said surface with a force effective to remove or partially remove from said fabric one or more of dyes, pigments or portions of the fabric material.

In accordance with a further aspect of the present invention, there is provided a method for the treatment of fabrics to produce textured or sculptured effects, which comprises protecting under controlled conditions a stream of particles towards a surface of a fabric, said particles contacting said surface with a force effective to remove or partially remove fabric material.

In accordance with still another aspect of the present invention, there is provided an apparatus for modifying fabrics to produce varied effects, which comprises means for supplying a length of fabric, said fabric having a first fabric surface and a second fabric surface, means for moving the fabric along a horizontal path in lengthwise direction, a first support backing positioned adjacent to said path, means for slidably pressing the second fabric surface against the first support backing, a first treating station located opposite from the first support backing, facing the first fabric surface and comprising means for propelling a stream of particles towards said first fabric surface, and means for removing treated fabric from said path.

DESCRIPTION OF THE PREFERRED EMBODIMENTS

Figure 3:
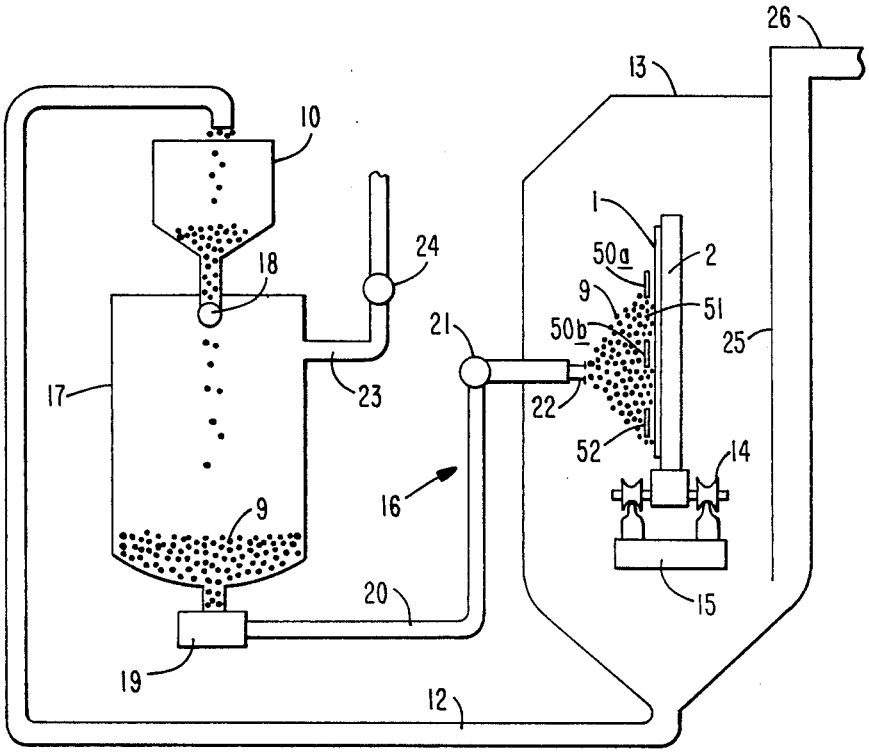
FIG. 3 is a schematic elevational view of apparatus useable in the process of the present invention and illustrates employment of a compressed air blasting system.

In the method of the present invention, a stream of particles is directed towards a surface of a fabric. The stream is in the form of a jet or blast of particles which may be projected by any controllable means of propelling the particles. They may be projected by entrainment in a fluid stream such as air or other gases or liquids such as water. Air released from a compressed air source with the released stream of moving air carrying with it said particles mixed therein has been found to be an effective means of projecting the particles. Commercially available sand blasting or air blaster equipment is useful. The compressed air may be mixed in a tank with the desired particles and released from a hose having a nozzle, or the compressed air may be released and the particles introduced into the resulting stream. The hose may be hand-held particularly for obtaining random design effects and may be contained in a cabinet, with manual or automated movement of the nozzle, the fabric or both, to bring the fabric into contact with the stream of particles. A suitable arrangement is shown in FIG. 3.

Figure 1:
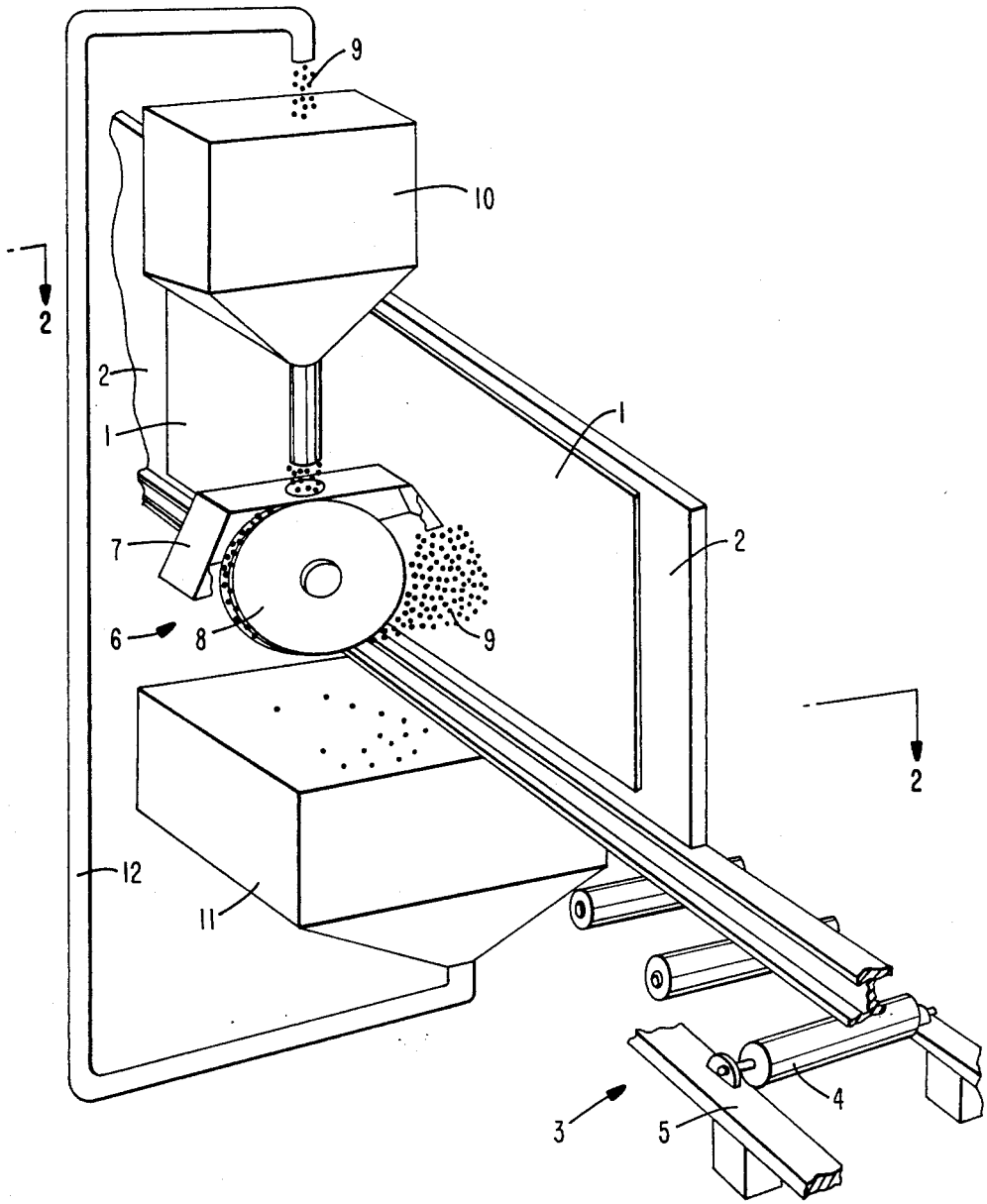
FIG. 1 is a perspective view of apparatus usable in the process of the present invention and illustrates use of a rotary blaster for projecting a stream of particles at a supported fabric.
Figure 2:
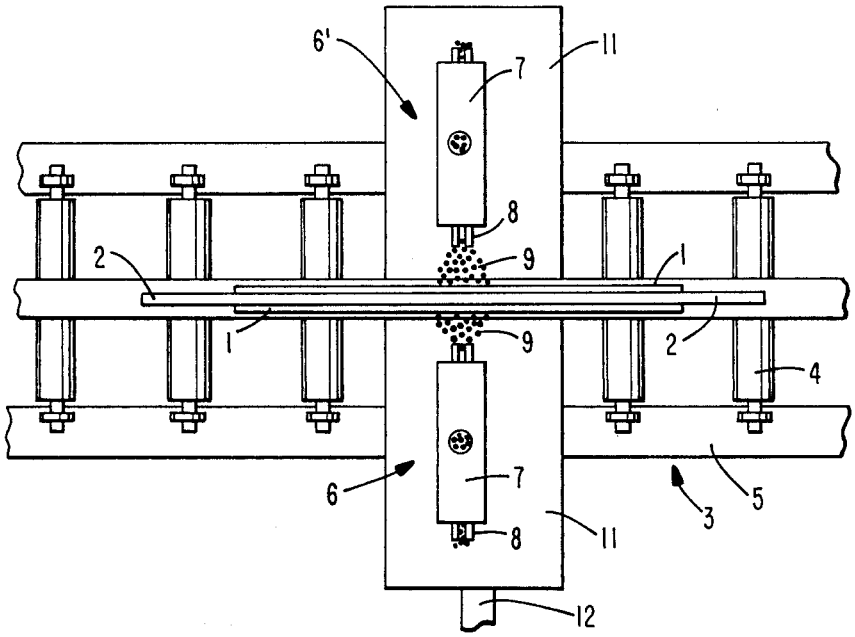
FIG. 2 is a plan view taken along the lines 2—2 of FIG. 1.

It has been found most preferable to utilize a centrifugal or rotary blaster for projecting the stream of particles. The technique and equipment for centrifugal wheel blasting is well-known and readily available commercially. In this technique, particles are supplied to a rapidly rotating wheel and are thrown with force away from the rim of the wheel. The particles may be applied to the rim surface of a wheel having a rim indentation or other structure which retains the particles until they have been accelerated and then thrown off the wheel. The rotating wheel may be equipped with internal paddles or blades directed radially from the hub, and particles may be applied either to the openings between blades at the rim of the wheel or to openings in the hub which communicate with spaces between the blades. The rotary blaster is airless, meaning that the particles are projected by being mechanically accelerated and are not carried along by the movement of a fluid as in other systems. The use of a centrifugal rotary blaster as the means of projecting particles in the present method is preferred since a considerable control over conditions involved in generating the stream of particles is possible. FIGS. 1 and 2 illustrate use of a rotary blaster in the method of the present invention.

After the particles contact the surface of the fabric, they are desirably collected and recycled to the supply source of particles, for reuse. Collection may be done simply by allowing the particles to fall by gravity into a collecting bin and conveying the collected particles to said source, or a stream of air may be used to convey the particles away from the fabric and into the collection system.

Regardless of the technique used to establish the stream of particles, it is essential that the particles should strike the surface of the fabric with a force effective to modify the fabric to achieve the desired effect. Thus, an effective force is one which is not so weak as to cause little or no effect on the fabric, and yet is not so strong as to cause an undesired significant weakening or degrading of the fabric. Certain desired effects may involve the creation of designs or sculpturing in which considerable portions of the fabric material are removed, causing a weakening of the fabric in those areas, but this would be a desired result for such an effect.

The extent or nature of the force imparted to the particles will widely vary, depending upon the type of effect desired and the nature of the fabric undergoing the treatment. The needed force can readily be determined by ordinary experimentation. To establish and maintain a desired effective force for the particles, it is essential to control the conditions under which the particles are protected. Particular conditions are quite variable since they are affected by the choice of equipment for the projecting of particles, the nature of the particles and other factors such as the distance established between the source of particles and the contact area on the fabric. Also, the nature of the fabric and the effect desired will affect the choice of particles. An effect such as softening fabrics would generally call for use of smooth, non-abrasive particles, whereas an effect such as sculpturing wherein considerable removal of portions of the fabric itself is contemplated might make the use of more abrasive particles having non-smooth, fractured or sharp-edged surfaces preferable. For any given effect on a given fabric, the extent or degree of the effect desired would influence the choice of particles or the duration of the treatment of any particular area of the fabric. Specific conditions are not determinable in general, but must be adapted to the specific instances involving a particular fabric and desired effect.

When it is desired to modify a specific type of fabric to obtain a certain effect, normally the type of particles and equipment will be chosen first. Then the conditions for establishing a stream of particles are readily determinable by simple experimentation. The essential aspect is to control the conditions of projecting the stream of particles such that an effective particle force for the particles contacting the fabric is obtained.

Normally, the controlled conditions will be established by selecting the properties of size, shape, momentum and rate of flow of the particles. The momentum of the particles will determine the extent of the force of impact on the fabric surface. This force of course is determined by the mass and velocity of the particles. However, different types of particles of the same mass will have different sizes and shapes. The momentum given to the particles also is influenced by the size, shape and rate of flow since the particles in motion will interact with the ambient atmosphere and will interact with each other such as by colliding. Therefore, the conditions of size, shape and rate of flow of particles will affect both the ultimate force of impact of the particles on the fabric and also will affect the intensity of the effect caused on the fabric. An abrasive particle will cause a more intense effect than a smooth particle.

The conditions which should be controlled also include the shape and size of the contact area of the particles on the fabric surface. At the same rate of flow of particles, dispersion over a large size area will cause a less intense effect than when concentrated on a small size area of the fabric surface. The shape of the area is a condition which is closely related to the type of effect desired. By way of example, a contact area of any shape provided that it spans the fabric from one edge to an opposite edge of the fabric is preferred for an overall softening treatment of the entire surface of the fabric. Removal of dye or material of the fabric in a selected area to create a design requires an appropriate shape of contact area corresponding to the limited area to be treated.

A further condition of importance is control over the movement of the fabric relative to the stream of particles. There may be no relative movement in some instances. For example, a piece of fabric or part of a garment may be introduced into a chamber and while stationary, subjected to a blast of a stream of particles for a short time, such as 0.5 to 10 seconds. Upon cessation of the blast, the piece of fabric can be removed and another piece brought into position for treatment. However, under normal production conditions, there would be relative movement between the stream of particles and the fabric to provide detailed effects or effects over a long extent of the fabric particularly under conditions where a continuous length of fabric or a continuous series of pieces of fabric is being treated. Either the stream of particles can be moved in relation to a stationary fabric length, or the length of fabric can be moved past a stream of particles emanating from a stationary source such that successive areas on the fabric are contacted by the stream of particles. Movement of the stream of particles relative to a stationary length of fabric would commonly be done in case of a hand-held source of particles for random or free-hand designs or other effects, or in the case where intricate designs are to be imparted to the fabric by an automated movement of the nozzle or other source of particles. For most treatments, however, it has been found to be most effective to move the fabric past a stationary source of particles. Under some circumstances, however, it would be desired to cause movement both of the source of particles and of the fabric, thereby obtaining unusual random or intricate effects. In any event, movement of the fabric relative to the stream of particles affects the intensity of action of the stream of particles since such movement influences the amount of particles which will contact a given portion of the fabric surface.

By choice of appropriate conditions along the lines illustrated above, an unusual variety of different effects can be obtained on a given fabric with the use of the same particle projecting equipment without substantial modification thereof. The types of blasters discussed above enable easy introduction of different kinds of particles through an ordinary hopper, to supply the accelerating device. A controlled metering of particles is obtainable by appropriate choice of nozzles for the air blaster or wheel structure for the rotary blaster. As a result, it becomes possible to obtain different effects on the fabric which include a softening or soft-hand feel, a worn or laundered appearance as well as the creation of designs, patterns, pictures, printing effects, textured effects or sculptured effects. These effects are achieved by causing the particles to remove or partially remove from the fabric substances including coatings, sizes, dyes, pigments or portions of the fabric material itself. By selecting, establishing and controlling the conditions for the stream of particles, the effect thereof can be adjusted so as to be strong enough to achieve the desired effect on the fabric, but not so strong as to cause undesired harm to the fabric. Thus, in the practice of the present invention it is possible to modify the fabric by the use of a force effective to modify the fabric without substantially degrading the physical properties of the fabric. It is also a feature of the invention that it becomes possible to subject different portions of the surface of the fabric to different intensities of particle force or different durations of contact with the particles. This enables production of gradual faded or shaded effects or ombre effects. These effects can be easily varied by causing the motion of the fabric to vary or be pulsating or discontinuous, by similar variation of the movement of the stream of particles, or by variation in the rate of flow of particles or shape of contact area while the fabric is moving at a continuous, unchanged rate. Such variations can easily be automated for a production line continuous treatment of fabrics.

Accordingly, not only is it possible to obtain a wide variety of effects in accordance with the present method, but these effects are obtained with control over the degree and location of the effect, while being able to utilize the same equipment for obtaining differing effects and use it on of different kinds of fabrics. The controlled obtaining of such a variety of effects on a wide range of fabrics with a single type of equipment is an unparalleled achievement over known art and practices. Moreover, a combination of such effects can be obtained during the treatment of the fabric. For example, one treatment may achieve both softening and removal of dye for a worn appearance. The fabric can be simultaneously or sequentially treated by two or more streams of particles or sequentially by the same stream in different locations or with different conditions.

Through this versatility of the method, the modification of fabrics can result in controlled fading, forming details or random designs, or patterns, or creating decorations, pictures, lace-like or embroidery-like effects, simulated leather effects such as graininess, sueding effects, napping, sculptured designs such as relief patterns, or printing effects such as decorations or names. The latter can be done either by removal of dye or removal of material of the fabric.

The above-described types of blaster equipment have been long known for cleaning surfaces and removing underlying material. However, such techniques have been applied to hard surfaces under harsh conditions such as descaling or removal of rust from metals and cleaning concrete. Certain equipment of that type has also been used to sculpture stone. It is therefore quite surprising that similar equipment can be employed in a process of treating fabrics which by their very nature are normally thin sheets of relatively soft or easily eroded materials. Moreover, the ability to control treatment on such thin and easily damaged material is an unpredictable aspect of the present invention.

The effect of the invention can be further varied by interposing a stencil between the stream of particles and the fabric surface. The stencil can be a sheet of impervious material having openings through which the particles can pass, or can be an impervious sheet without openings, such sheet being of a size or being positioned in the stream of particles such that the particles pass only around the outer perimeter of the sheet into contact with the surface of the fabric. A combination effect can be obtained with a stencil having openings wherein the particles pass through the openings and outside the perimeter of the stencil. Where particles pass through the openings in the stencil, the surface of the fabric is contacted by the particles in areas substantially corresponding to the areas of the openings in the stencil. The correspondence of areas will be affected by the distance of the stencil from the fabric surface. The use of a stencil allows the particles to contact the fabric surface in selected areas creating a pattern or design in contrast with adjacent areas which are not contacted. This enables a variety of effects such as the creation of pictures, designs, patterns, sculptured effects on pile fabrics or lace-like and embroidery-like effects. Further, the stencil enables printing-like effects such as the appearance of words or symbols.

Sharply defined designs, printing or other effects are obtained when the stencil is positioned more closely near the fabric surface, and at longer distances from the surface effects can be obtained in which the borders of treated areas of the surface have the appearance of a diffuse rather than a sharp effect. When the stencil is positioned to enable the particles to contact the fabric surface outside an area of that surface substantially corresponding to an area bounded by part or all of the perimeter of the stencil, the contacted area can be given a faded or shaded effect wherein the fabric is decolored or lightened or otherwise affected most intensely adjacent to the area of the surface subtended by the stencil, the effect gradually decreasing at greater distances from said area.

When contacted with the stream of particles, it is advantageous for the piece or length of fabric to be held under tension or positioned against a support surface. The lengths or pieces of the fabric desirably are mounted on a support frame or support backing for bringing the fabric into and out of contact with the stream of particles. A support frame may allow part of the surface of the fabric which contacts the frame to be exposed, such that a simultaneous contacting of the reverse side of the fabric with a stream of particles can be conducted while treating the front side of the fabric. In treatment of continuous sheets or lengths of fabric, the continuous length is moved along a path; at a location in the path one surface of the sheet may be supported by pressing against a backing roll or plate and the surface of the sheet opposite to the supported surface may be brought into and out of contact with the stream of particles.

In a further preferred embodiment of the invention, dust and adhered particles may be removed from the fabric after it has been contacted with the stream of particles. The size and nature of the particles and the type of treatment will determine whether any dust is created from the particles or the fabric, and whether any particles will adhere to the surface of the fabric or be embedded in the structure of it. Depending upon these factors, it may be decided to employ a cleaning step after treatment with the particles. This cleaning or removing of dust and adhered particles may be done mechanically by shaking or agitating the fabric or by blowing air or another gas or fluid onto the surface of the fabric or through the fabric. Advantageously, the air is blown at the side of the fabric opposite to the side which was treated by the stream of particles.

A preferred cleaning technique is done by placing one side of the fabric under a vacuum and directing either continuous or pulsating streams of pressurized air against the other side of the fabric. It is preferred to place the particle-treated side of the fabric under vacuum and direct jets or streams of air against the other side. The fabric surface may be placed under vacuum in this embodiment by contacting the fabric surface with a semi-enclosed housing the areas of contact of the housing with the fabric being partially sealed by means of brushes or the like, and air being exhausted from the housing to create the vacuum.

An alternate technique is to remove adhered particles electrostatically. When the stream of particles is projected at the fabric, the particles frequently will have an electrostatic charge resulting from the technique of projecting, or such charge can be imparted to the particles. Then, an opposite electrostatic charge is imparted to the fabric or to air which is blown onto or through the fabric. The particles then will contact the fabric due to the momentum of said particles, but will tend to be repelled after contact, because of the differing electrostatic charge. The charge can be applied to the fabric at a location after contact with the particles when the fabric has moved away from the stream of particles.

Where the particles are composed of a metal capable of being magnetized, the cleaning step can take the form of removing any adhered particles from the fabric by magnetic attraction, such as by bringing a magnetized surface adjacent to or in contact with the fabric surface after treatment.

It can be seen from the hereinabove description that a very wide variety of particles may be employed for the stream of particles projected at the fabric. The above-mentioned conditions for the particles can generally be established for any type of particle and the choice of particles generally will be made on the basis of whether the effect desired is best achieved with a smooth non-abrasive particle or with an abrasive one. The type of equipment used for projecting the particle may influence the choice of a particle having more or less mass for a given desired size. Thus, the particles used typically will be any of the particles which are commonly employed in equipment of the type selected for projecting the particles. Normally, said particles are grits, shot, balls, spheroidal, cylindrical, cut wire or crushed materials. In particular, it has been found useful to utilize particles of steel, stainless steel, iron, aluminum, sand, slag, silicon dioxide, aluminum oxide, silicon carbide, garnet, crushed or uncrushed seeds, nuts, hulls, nutshells or fruit pits, plastics or glass. For example, glass or plastics could be used in the form of uncrushed beads having a smooth shape, or could be crushed or shaped into cylinders, etc., to create a more abrasive particle. The preferred particle for use is aluminum oxide because of its availability, compatability with the equipment normally used, ability to be recycled and capability for use in obtaining a wide variety of effects on the fabric.

The particle size may be selected based on a combination of factors discussed above in order to obtain the desired conditions. It has been found effective to utilize a blend of sand grit having mesh sizes 20, 30 and 50. Aluminum oxide is effectively used in mesh size 80–100 but many other sizes are useful. Shells are typically are crushed so that the particle size range is 0.01–0.13 inch. The size of plastic particles typically is 0.03–0.06 inch. Aluminum spherroids may also be used (aluminum metal or alloy); the size of such particles typically being 0.0017–0.0937 inch. Iron shot which is used may have a screen size of 7–120 (screen opening 2.80 mm–0.125 mm). A typical size for grit such as iron grit is in a screen size of 7–200 (screen openings 2.80 mm–0.075 mm). Cut stainless steel wire is used typically in size ranges of 0.024×0.024 inch to 0.062×0.062 inch.

In general, any kind of fabric may be treated in accordance with the present invention. Thus, the invention enables modification of any thin or thick, light or heavy, flexible material from any combination of cloth, fiber, polymeric film, sheet, foam or the like. The fabric to be treated may be a textile or non-textile, it may be woven or non-woven, natural, manmade or synthetic, or it may be a blend of more than one such material. The fabric to be treated can be useful in respect of many end-uses, particularly as a garment, upholstery, apparel, toweling, carpeting, curtain, bedclothing or wall covering fabric.

Amongst such fabrics in particular are included denim, cotton, silk, leather, suede, corduroy, velour, velvet, fur, wool, rayon, canvas, linen, and synthetics such as polyester, nylon, and the like.

Some effects or modifications are normally desired particularly with respect to certain kinds of fabrics. Thus, in particular where the desired effect is softening (soft-hand) or a worn or laundered effect, the treatment being effective to remove or partially remove coatings, sizes, dyes or pigments, it is particularly preferred to direct such treatment towards denim fabrics. Denim is also a preferred fabric where the treatment is directed to form designs, patterns, pictures or printing effects such that the particles remove from the fabric or partially remove from it one or more of dyes, pigments or portions of the fabric material.

In cases where the effect desired is a textured or sculptured effect and the particles are controlled so as to contact the surface of the fabric with a force effective to remove or partially remove fabric material, the preferred fabrics for treatment are pile, napped, hooked, natural or man-made leather, natural or man-made fur, corduroy, velour or velvet fabrics. Among these particularly preferred are fabrics which are natural or man-made leather. These may be treated to produce a suede effect and in connection with man-made leather the appearance may be enhanced by creating a grain or leather-like surface. Where the texturing or sculpturing treatment is to produce an embroidery-like or lace-like effect, this can be done on a number of fabrics, particularly denim, cotton, silk and synthetics.

The method of the present invention is effective and can be applied at different stages of manufacture of the fabric or of articles made from the fabric. For example, the treatment can be applied to unfinished or greige goods, or to finished goods which for example have been subjected to dyeing and dry or wet finishing, or to finished coated or uncoated fabrics.

In many cases the effects of the invention can be obtained by application of the method to a garment or other article made from the fabric. Further, manufactured parts of such garments or articles can be subjected to the method. For example, pockets to be used as a part of a garment can be manufactured and the method can be employed to produce designs or names such as "decorator" names on such pockets.

As shown in FIGS. 1 and 2 of the drawings, fabric may be treated in accordance with the invention by being moved past a rotary blaster. Fabric 1 is mounted by mounting means such as edge clamps (not shown) on vertical support 2. It is preferred to mount the fabric vertically. By means of conveyor 3 including rollers 4 and roller support 5, fabric 1 is moved past rotary blaster 6 which includes a protective housing 7 and centrifugal wheel 8. Particles are supplied by hopper 10 to the wheel 8 where they are thrown off to form particle stream 9 which contacts fabric 1. Fabric 1 may be individual mounted pieces as shown or a length or continuous length. The particles are collected in a collector bin 11 and passed through a return duct 12 by means of conveyors such as screw conveyors and elevator systems as is known in the art, and such particles are returned to hopper 10. The wheel 8 may be spun by a motor with appropriate controls, and the blaster 6 may be enclosed by a protective or dust housing and will have support and positioning elements, all of which are not shown but are conventional in the art. On the opposite side of support 2 additional pieces or lengths of fabric 1 may be attached and treated by a second blaster 6' as may be seen in FIG. 2.

An air blaster may be utilized, as illustrated in FIG. 3. Fabric 1 is mounted on support 2 by mounting means (not shown), with support 2 being in the form of a trolley having wheels 14. Support 2 is moved on support rails 15 which extend into and out of protective cabinet 13. Thus, a plurality of such trolleys each bearing a piece or length of fabric may be successively introduced to said cabinet through suitable sealing doors or flaps (not shown). Particles from hopper 10 are introduced through a pressure actuated valve 18 into pressure tank 17, pressurized by air from air supply duct 23 having valve 24. The particles and compressed air enter mixing chamber 19 and are conveyed by pressure of said air through duct 20 and valve 21 into nozzle 22 where the compressed air and particles are released forming a stream of particles 9 which contacts fabric 1. The particles which have contacted fabric 1 are directed downwardly by the flow of air into particle collector 11. The exhaust air leaves through exhaust duct 26 formed by baffle 25 and the wall of cabinet 13. The collected particles in collector 11 are returned to hopper 10 through return duct 12 by means of screw conveyors and elevators (not shown).

Shown in cross-section is upper strip 50*a* and lower strip 50*b* of a conventionally constructed and mounted stencil, the strips defining an opening 51 through which the surface of the fabric is contacted by the particles in an area substantially corresponding to the area of the opening 51. Another such stencil strip 52 is positioned so that the surface of the fabric is contacted by the particles outside an area of the surface of the fabric substantially corresponding to the area of strip 52.

Figure 4:
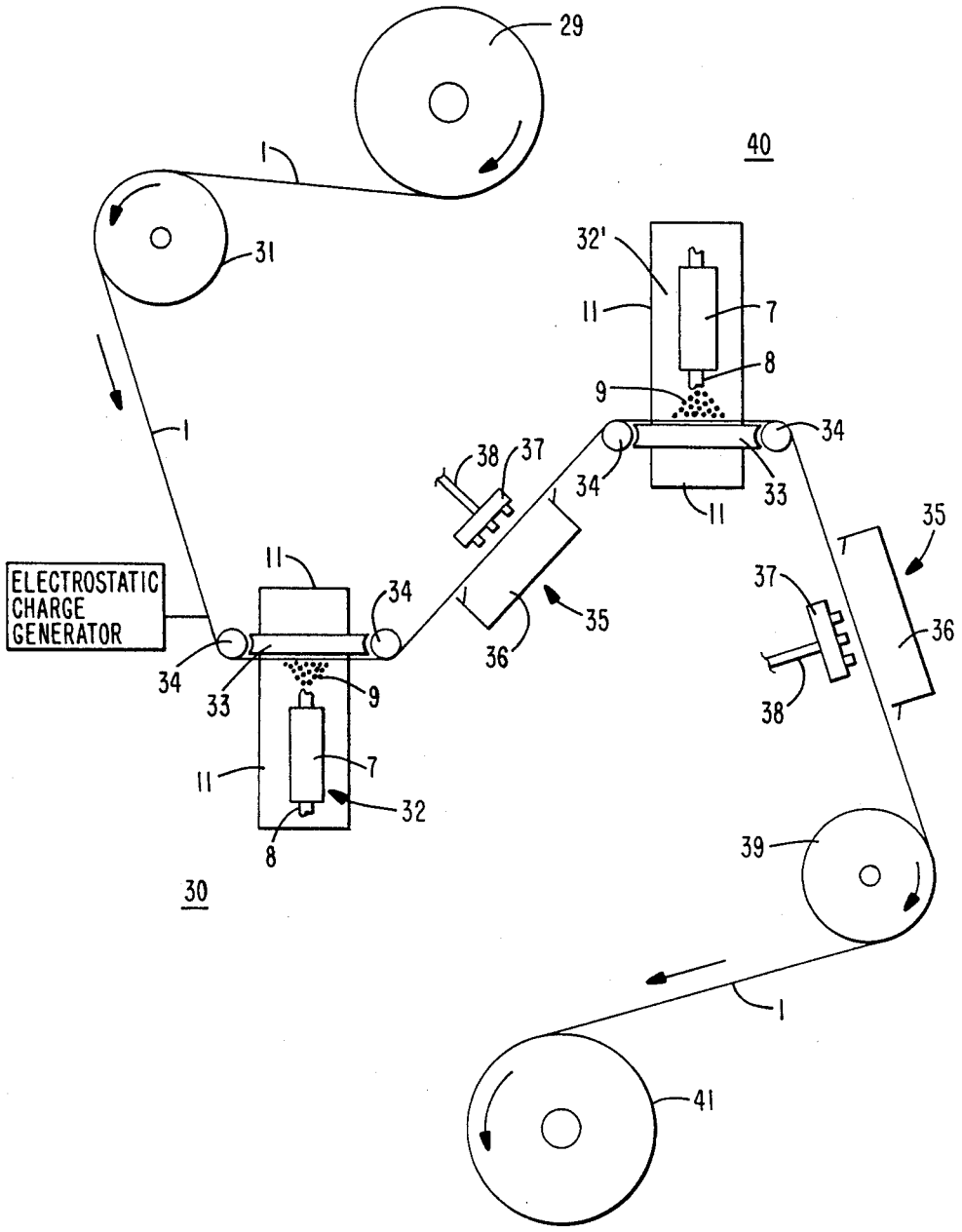
FIG. 4 is a schematic plan view of a fabric treatment line of the present invention and illustrating a continuous treatment of fabric in accordance with the present method.

For illustrative purposes, the preferred type of blaster, an embodiment of which is shown in FIG. 1, is employed in a production or treatment line as shown in FIG. 4. A fabric supply 29 may be from a roll or other supply of fabric. Fabric 1 is moved along a horizontal path following a treatment line in the direction shown by arrows, and by means of roll 31 and rollers 34 is pressed against a support backing in the form of support plate 33. The plate is preferably flat but can be arcuate or can be replaced by a backing roll of large radius. Opposite to the support plate a first treating station 30 is located. The treating station employs blaster 32 which includes housing 7, rotary wheel 8 and particle collector 11, all being as illustrated in FIG. 1, whereby a stream of particles 9 is directed against fabric 1. Following first treating station 30, the fabric is cleaned by cleaner 35 which includes vacuum chamber 36, and air jets 37 supplied by air duct 38. The fabric then is moved to a second treating station 40 where it is pressed against another support plate 33 by means of rollers 34 and is treated by blaster 32' having the same components as described in respect of first station 30. However, blaster 32' is positioned to treat the side of the fabric opposite to the side treated at first treating station 30. Alternatively, the second treating station may be omitted along with its subsequent cleaner 35 of the same construction as described previously. In another embodiment, second treating station 40 may be positioned to treat the same surface of the fabric as was treated at first treating station 30, with the purpose of employing different treatment conditions for a different effect on the fabric. For example, first treating station 30 may provide an effect of laundering appearance, while second treating station 40 may be used to impart a design to the fabric. The treated fabric 1 is moved away from the treatment station by suitable means such as roll 39 and is collected at take-up roll 41 or is directed further to other processing units. As is readily apparent, further treating stations may be introduced into the line.

The following examples are illustrative of the invention:

EXAMPLE 1

Six denim fabric samples identified as A to F were treated in accordance with the method of the present invention. The samples were all approximately six feet long and made of 100% cotton woven denim. These samples were of different fabric weights, samples E and F being light weight fabrics and A to D of a heavier weight. The fabrics also were of a differing stage of manufacture. Samples A, B, C and F were of a finished fabric, that is, dyed goods ready for manufacturing into garments. Samples D and E were greige goods, that is, goods as obtained from the loom prior to being subjected to the finishing procedure.

The tensile strength, tear strength and fabric weight of each sample was measured before treatment and after treatment. Measurement of the tensile strength was in accordance with ASTM Standard Test Method D1682-64 (Reapproved 1975), said test method being incorporated herein by reference. In this test a fabric specimen is gripped by opposed jaws of 1 inch width. A continually increasing load is applied longitudinally to the specimen, and the test is carried to rupture in a specific time. Values for the breaking load of the test specimen are obtained from machine scales reading in pounds, so that the test result is expressed is lbs/in width of specimen. The tear resistance of the samples was determined by a test in accordance with ASTM Standard Test Method D 1424-83, said test method being incorporated herein by reference. In the tear resistance test, the average force required to continue a tongue-type tear in a fabric is determined by measuring the work done in tearing it through a fixed distance. The tester consists of a sector-shaped pendulum carrying a clamp which is in alignment with a fixed clamp when the pendulum is in the raised, starting position with maximum potential energy. The specimen is fastened in the clamps and the tear is started by a slit cut in the specimen between the clamps. The pendulum is then released and the specimen is torn as the moving jaw moves away from the fixed one. The scale attached to the pendulum is graduated so as to read directly the tearing force in pounds.

Each sample was prepared for treatment by mounting the sample of fabric on a metal support plate having a rubber layer, the fabric contacting the rubber layer and being clamped under tension at the edges of the support plate. The support structure was mounted vertically on a cart and the face of the fabric was passed in front of a stationary blaster apparatus having two rotary wheels each throwing a stream of particles at the surface of the fabric being moved across the path of said streams, such that a blast pattern of equal density of particles was applied in an elongated area extending from the bottom edge to the top edge of the mounted fabric surface. By movement of the fabric sample completely past the blaster apparatus, the entire surface of the fabric sample facing the blaster was treated, except for the edge areas which were clamped. The blaster was a "WHEELABRATOR" (Registered Trade Mark) blaster made by Wheelabrator-Frye Inc., 400 South Byrkit Ave., Mishawaka, Ind. The particles were assorted steel shot of mixed size about 80 mesh-16 mesh. Distance from outlet of the wheels to the fabric surface was about 5 feet and the fabric was moved past the front of the blaster at a rate of about 4 yards of fabric length per minute of passage time.

Sample A was treated by one pass on both sides, meaning that the treatment was done on one entire side and then the fabric sample was reversed on the support and the same treatment was applied to the thus-exposed reversed side of the fabric. Sample B was treated by a first passage treating the exposed surface and by repeating this treatment on the same exposed side, so that as a result one side of the fabric sample was subjected to two passes. Each of samples C, D, E and F were subjected to a single treatment passage, only one side being treated.

The treatment conditions and test results are shown in the following Table. It can be seen from the test results that as a result of the treatment, the fabric weight generally decreased somewhat, with multiple passes causing a proportionally larger decrease than in the case of single passes. The tensile strength of the treated specimens decreased as compared with the specimens prior to treatment, but the decrease was within acceptable levels such that the treated fabrics were all of a satisfactory strength for manufacturing into garments. It is surprising that the tear resistance of the treated samples was improved over the untreated fabric (the force required to tear the fabric was greater after treatment), for most of the samples and frequently in both of the test directions. Each test was done both in the warp (W) direction and in the filling (F) direction. That is, the warp yarns or the filling yarns were respectively subjected to tension for the tensile test and subjected to tearing for the tear test.

Following each treatment, the fabric sample was observed to become softer to the touch and feel, and changed from the loom state (dark blue color) to a faded or lighter color.

TABLE

| Sample | Fabric Type | Treatments | Tensile Test: Breaking Load, Lbs. W × F(1) | Tear Test: Breaking Force, Lbs. W × F(1) | Weight, Oz/Yd² | Width, Inches |
|---|---|---|---|---|---|---|
| A Untreated | Finished | 1 Pass Both | 223 × 167 | 11.5 × 13.1 | 15.5 | |
| Treated | | Sides | 199 × 149 | 13.3 × 13.4 | 13.7 | 68 |
| B Untreated | Finished | 2 Passes | 217 × 180 | 11.9 × 12.0 | 15.2 | |
| Treated | | | 189 × 152 | 11.8 × 13.2 | 14.8 | 67½ |
| C Untreated | Finished | 1 Pass | 221 × 171 | 11.4 × 11.6 | 14.1 | |
| Treated | | | 194 × 151 | 12.0 × 13.1 | 13.8 | 67¾ |
| D Untreated | Greige | 1 Pass | 214 × 150 | 13.6 × 12.5 | 12.6 | |
| Treated | | | 197 × 143 | 13.2 × 14.2 | 12.6 | 69⅜ |
| E Untreated | Greige | 1 Pass | 169 × 63 | 10.7 × 5.9 | 9.8 | |
| Treated | | | 146 × 60 | 12.1 × 5.6 | 8.8 | 63 |
| F Untreated | Finished | 1 Pass | 157 × 72 | 10.8 × 5.6 | 8.0 | |
| Treated | | | 135 × 60 | 9.6 × 7.4 | 8.0 | * |

(1)W × F = Warp direction by filling yarn direction.
* Not measured

EXAMPLE 2

Another piece of denim fabric corresponding to sample A of Example 1 is treated with the same procedure as in Example 1 except that the blaster apparatus includes only a single wheel and is adjusted to form a stream of particles impinging on a more limited area near the surface of the fabric. The fabric is supported with its length in the horizontal direction of movement of the fabric and its width positioned vertically. The particle stream forms an area of about 0.5 foot wide by about 1 foot high near the fabric surface. A stencil comprising a ¼ inch steel plate 4 feet wide by 5 feet high is interposed between the fabric and the blaster, at a distance of 0.5 inch from the fabric. The stencil is solid except for a central area corresponding to the area of impingement of the stream of particles, in which is located three 1 inch high by 0.5 inch wide rectangular openings, one above the other, spaced 2 inches from each other. The fabric is moved past the blaster during the treatment and a design consisting of a series of three horizontal faded stripes running the length of the fabric is obtained.

EXAMPLE 3

A continuous length of denim fabric having characteristics of the type indicated in sample A of Example 1 is treated in an apparatus in accordance with FIG. 4 of the drawings except that the apparatus comprises a single treating station including a blaster apparatus as defined in Example 1 followed by a vacuum and air jet cleaner. The treatment conditions are the same as in Example 1. A softened, faded treated fabric is continuously obtained.

EXAMPLE 4

A piece of denim fabric corresponding to sample A of Example 1 is treated as in Example 1 except that a single wheel is used with aluminum oxide grit particles of 80–100 mesh size. By positioning the wheel closer to the fabric and adjusting conditions, the blast pattern is confined on the surface of the fabric to an area of about 12 inches high by 2 inches wide. Upon treating the fabric, there is obtained a design consisting of a faded stripe running horizontally along the length of the piece of fabric.

EXAMPLE 5

The treatment of Example 1 is repeated, however using plastic particles consisting of extruded plastic cut to cylindrical shape of a size being 0.03 inch length and 0.03 inch diameter. Upon treatment, a softened, faded denim fabric is obtained.

EXAMPLE 6

A denim fabric in accordance with sample A of Example 1 is treated under conditions as specified in Example 1, however with the particles being replaced by crushed natural materials comprising nutshells and fruit pits. Upon treatment, softened, faded denim fabric is obtained.

EXAMPLE 7

A natural leather fabric suitable for making leather jackets is treated in accordance with the conditions of Example 1 except that the particles used are aluminum oxide, the distance between the blaster wheel and fabric surface is decreased, and the rotational speed of the wheels is increased. A suede texture effect is obtained on the treated leather.

EXAMPLE 8

A heavy weight cotton pile toweling fabric is substituted for the denim fabric of Example 2 and treated as in Example 2 but with closer positioning of the blaster wheel to the stencil surface. A sculptured pattern of depressed areas corresponding to the position of the openings in the stencil is obtained, the depressed areas being in the form of stripes running horizontally the length of the fabric.

EXAMPLE 9

A commercially available sand blaster was employed to create a stream of released compressed air containing accelerated particles of aluminum oxide grit of 80–100 mesh, this stream being projected from a hand-held nozzle. Denim fabric pieces of a type corresponding to sample A of Example 1 were mounted against a wooden support plate by edge clamping, the fabric being flattened by the clamping tension. The nozzle was held at varying distances from the fabric from 6 to 18 inches, and both the fabric and nozzle were contained in a blast cabinet. By traversing the nozzle across the stationary fabric, a random design pattern of faded areas was obtained on the surface of the fabric. The resulting fabric sample having a random design was found to be of a physical quality suitable for manufacture into garments.

EXAMPLE 10

The procedure of Example 9 was repeated, but there was interposed between the fabric surface and the stream of particles a stencil having openings corresponding to the outline of city buildings. A design was obtained on the fabric consisting of a picture of city buildings.

EXAMPLE 11

The procedure of Example 9 was repeated but a stencil was interposed between the fabric surface and the stream of particles. The stencil had openings corresponding to a lace-like pattern. The stencil was smaller in size than the area of impingement of said stream of particles with the surface of the fabric. There was obtained a design pattern on the surface of the fabric consisting of a shape in the form of the shape of the stencil. Within the design pattern there was formed faded areas corresponding to openings in the stencil, giving a lace-like effect. Areas corresponding to solid portions of the stencil remained dark blue in color, the original color of the dyed denim. In an area outside the perimeter of the design pattern, there was obtained a faded effect, most faded near the perimeter of the design pattern and gradually less faded away from the perimeter.

EXAMPLE 12

The procedure of Example 10 is repeated, but with use of a stencil positioned very closely to the surface of the fabric and having openings in the form of letters, arranged as words. There is obtained a design consisting of faded portions on the fabric surface in the shape of letters corresponding to the openings in the stencil.

It is contemplated that the inventive concepts herein described may be variously otherwise embodied and it is intended that the appended claims be construed to include alternative embodiments of the invention except insofar as limited by the prior art.

What is claimed:

1. A method for the treatment of denim fabrics to produce an effect selected from a softening (soft-hand) effect, a worn effect, a laundered effect and combinations thereof, which comprises projecting under controlled conditions a stream of particles towards a surface of a denim fabric, the particles contacting said surface with a force effective to at least partially remove from said fabric at least one substance selected from the group consisting of coatings, sizes, dyes and pigments.

2. A method according to claim 1, further comprising additionally producing a design effect on the fabric.

3. A method according to claim 1, wherein said controlled conditions are established by selecting the properties of size, shape, momentum and rate of flow of said particles, shape and size of the contact area of said particles on said surface; and movement of the fabric relative to the stream of particles.

4. A method according to claim 1, wherein said force is effective to modify said fabric without substantially degrading the physical properties of said fabric.

5. A method according to claim 1, wherein said particles are projected by entrainment in a fluid stream.

6. A method according to claim 1, wherein said fluid is air released from a compressed air source.

7. A method according to claim 1, wherein said particles are projected by being mechanically accelerated and directed towards said surface.

8. A method according to claim 7, wherein said particles are projected by a centrifugal wheel blaster.

9. A method according to claim 1, wherein after contact with said surface, the particles are collected and recycled to said stream of particles.

10. A method according to claim 1, wherein a stencil is interposed between said surface and said stream of particles.

11. A method according to claim 10, said surface is contacted by said particles in areas substantially corresponding to areas of openings in said stencil.

12. A method according to claim 10, wherein said surface is contacted by said particles outside an area of said surface substantially corresponding to an area bounded by the perimeter of said stencil.

13. A method according to claim 1, wherein different portions of said surface are subjected to different intensities of particle force, whereby gradual faded or shaded effects, or ombré effects are obtained.

14. A method according to claim 1, wherein said particles are selected from materials consisting of grit, shot, balls, spheroidal, cylindrical, cut wire and crushed materials.

15. A method according to claim 1, wherein said particles are selected from materials consisting of steel, stainless steel, iron, aluminum, sand, slag, silicon dioxide, aluminum oxide, silicon carbide, garnet, crushed and uncrushed seeds, nuts, hulls, nut shells and fruit pits, and plastics and glass.

16. A method according to claim 1, wherein lengths or pieces of the fabric are mounted on a support backing and said surface is brought into and out of contact with said stream of particles.

17. A method according to claim 1, wherein a continuous sheet of fabric is moved along a path, at a location in said path one surface of the sheet is supported by being pressed against a backing roll and the surface of the sheet opposite to the supported surface is brought into and out of contact with said stream of particles.

18. A method according to claim 1, wherein both surfaces of the fabric are contacted with a stream of said particles.

19. A method according to claim 1, further comprising removing dust and adhered particles from said fabric after contacting said surface with said stream of particles.

20. A method according to claim 23, wherein said dust and adhered particles are removed mechanically by shaking the fabric.

21. A method according to claim 19, wherein said dust and adhered particles are removed by placing one side of the fabric under vacuum and directing pressurized air against the other side of the fabric.

22. A method according to claim 19, wherein adhered particles are removed electrostatically by imparting an electrostatic charge to said fabric, said electrostatic charge being opposite to an electrostatic charge possessed by or imparted to the particles in said stream of particles.

23. A method according to claim 19, wherein said adhered particles are composed of a metal capable of being magnetized and said adhered particles are removed from the fabric by magnetic attraction.

* * * * *